US010086964B2

(12) United States Patent
Thring et al.

(10) Patent No.: US 10,086,964 B2
(45) Date of Patent: Oct. 2, 2018

(54) FEED CONTROL SYSTEM FOR A LIDDING WEB

(71) Applicant: H G MOLENAAR AND COMPANY PROPRIETARY LIMITED, Paarl (ZA)

(72) Inventors: Tom Lawrence Thring, Cape Town (ZA); Wynand Van Der Westhuizen, Wellington (ZA); Stefan Molenaar, Paarl (ZA)

(73) Assignee: H G MOLENAAR AND COMPANY PROPRIETARY LIMITED, Paarl (ZA)

( * ) Notice: Subject to any disclaimer, the term of this patent is extended or adjusted under 35 U.S.C. 154(b) by 539 days.

(21) Appl. No.: 14/864,523

(22) Filed: Sep. 24, 2015

(65) Prior Publication Data

US 2016/0114924 A1 Apr. 28, 2016

(30) Foreign Application Priority Data

Oct. 23, 2014 (ZA) ..... 2014/07752

(51) Int. Cl.
*B65B 57/04* (2006.01)
*B65B 41/18* (2006.01)
*B65B 7/16* (2006.01)

(52) U.S. Cl.
CPC ..... *B65B 57/04* (2013.01); *B65B 7/164* (2013.01); *B65B 41/18* (2013.01)

(58) Field of Classification Search
CPC ..... B65B 7/164; B65B 41/18; B65B 57/04
USPC ..... 53/51, 75, 299, 329.2–329.5
See application file for complete search history.

(56) References Cited

U.S. PATENT DOCUMENTS 3,140,573 A * 7/1964 Buttolph ..... B65C 9/44 53/51
3,262,349 A * 7/1966 Hollenton et al. ..... A24D 1/16 53/51
3,861,983 A * 1/1975 Harrell ..... B65B 41/18 53/51
4,217,163 A * 8/1980 Utzmann et al. ..... B65B 9/042 53/51

(Continued)

FOREIGN PATENT DOCUMENTS

DE 1119754 B * 12/1961 ..... B65B 41/18
DE 2215223 A1 * 9/1973 ..... B65B 41/18
DE 2715386 A1 * 10/1977 ..... B65B 41/18

*Primary Examiner* — Stephen F Gerrity
(74) *Attorney, Agent, or Firm* — Foley & Lardner LLP

(57) ABSTRACT

A lidding system for heat sealing a lidding web onto open-topped plastic containers includes a heat sealing head including heat sealing dies and a number of carrier plates for supporting a queue of containers. The carrier plates are displaced past the sealing head and define transverse slots between them. The system includes an optical sensor for sensing the a position of labels on the lidding web, and further includes a pair of pleating bars movable in a vertical direction and extending transversely relative to the direction of travel of the carrier plates. The system includes a PLC linked to the optical sensor for actuating displacement of the pleating bars into lowered positions wherein the bars are received in the slots to form pleats in the lidding web, thereby adjusting the position of the labels relative to the containers, in response to the labels not being sufficiently aligned with the containers.

6 Claims, 11 Drawing Sheets

(56) References Cited

U.S. PATENT DOCUMENTS 4,819,413 A * 4/1989 Mancini ..... B65B 7/2814
53/329.3
4,866,907 A * 9/1989 Iuchi et al. ..... B65B 7/28
53/299
4,989,393 A * 2/1991 Sell et al. ..... B65B 7/164
53/299
5,067,307 A * 11/1991 Francioni et al. ..... B65B 57/06
53/51
5,802,821 A * 9/1998 Albrecht ..... B65B 7/164
53/51
6,021,629 A * 2/2000 Sterner, Sr. ..... B65B 41/18
53/51
7,762,301 B2 * 7/2010 Mathea ..... B65H 23/1882
53/51

* cited by examiner

FEED CONTROL SYSTEM FOR A LIDDING WEB

CROSS-REFERENCE TO RELATED APPLICATION[N]

This application claims the benefit of and priority to South African Provisional Patent Application No. 2014/07752, filed Oct. 23, 2014, the contents of which are incorporated herein by reference in their entirety.

FIELD

This invention relates to a feed control system for a lidding web. The invention also relates to a lidding system for sealing open-topped containers.

SUMMARY

According to a first aspect of the invention there is provided a feed control system for controlling a feed of a lidding web and having a plurality of indicia marked thereon in a predetermined pattern, for sealing open-topped containers having top peripheral flanges, the lidding web being fed relative to a queue of the containers which are carried by longitudinally-spaced carrier plates in a linear direction past a sealing head including a number of sealing dies which are each configured to seal the lidding material onto the flange of one of the containers, the lidding material being dispensed by the movement of the carrier plates after the lidding material has been sealed onto leading containers in the carrier plates, the feed control system including:

indicia sensing means for sensing a position of the indicia on the lidding web;

at least one web adjustment bar which extends transversely relative to the linear direction of travel of the carrier plates and which is moveable between a raised position wherein the web adjustment bar is spaced above the web of lidding material and a lowered position wherein the web adjustment bar depresses the lidding web downwardly into a space defined between two longitudinally-adjacent carrier plates so as to form a pleat in the lidding web thereby to adjust the position of the indicia marked on the web, relative to the position of the containers; and control means for actuating said movement of the web adjustment bar into the lowered position thereof for forming the pleat in the lidding web, in response to a signal received from the indicia sensing means indicating a deviation of a predetermined magnitude of said position of the indicia on the lidding web, from a reference position of the indicia wherein the indicia are in register with the containers to be lidded.

According to a second aspect of the invention there is provided a lidding system for sealing open-topped containers which each have a top peripheral flange, the lidding system including:

support means for supporting a lidding web for sealing the containers, the lidding web having a plurality of indicia marked thereon in a predetermined pattern;

a sealing head including a number of sealing dies which are each configured to seal the lidding web onto the flange of one of the containers;

carrier means for supporting and conveying the containers, including a plurality of longitudinally-spaced carrier plates for supporting a queue of the containers, the carrier means defining transversely-extending recess formations between adjacent carrier plates;

displacement means for displacing the carrier plates in a linear direction past the sealing head; and a feed control system comprising:

a) indicia sensing means for sensing a position of the indicia on the lidding web;

b) at least one web adjustment bar which extends transversely relative to the linear direction of travel of the carrier plates and which is moveable between a raised position wherein the web adjustment bar is spaced above the web of lidding material and a lowered position wherein the web adjustment bar depresses the lidding web downwardly into a particular one of the recess formations defined between two adjacent carrier plates so as to form a pleat in the lidding web thereby to adjust the position of the indicia marked on the web, relative to the position of the containers; and c) control means for actuating said movement of the web adjustment bar into the lowered position thereof for forming the pleat in the lidding web, in response to a signal received from the indicia sensing means indicating a deviation of a predetermined magnitude of said position of the indicia on the lidding web, from a reference position of the indicia wherein the indicia are in register with the containers to be lidded.

The lidding system may be operable to heat seal the lidding web onto the containers. As such, the lidding web and the containers may be of compatible heat-sealable material, with the sealing dies of the sealing head being in the form of heat sealing dies.

The lidding web may be provided in a roll, in which case the support means is configured to support a roll of the lidding web.

The sealing head may be moveable relative to the carrier means so as to provide for sealing of the lidding web onto the flanges of predetermined containers supported by the carrier means.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DETAILED DESCRIPTION

Figure 1:
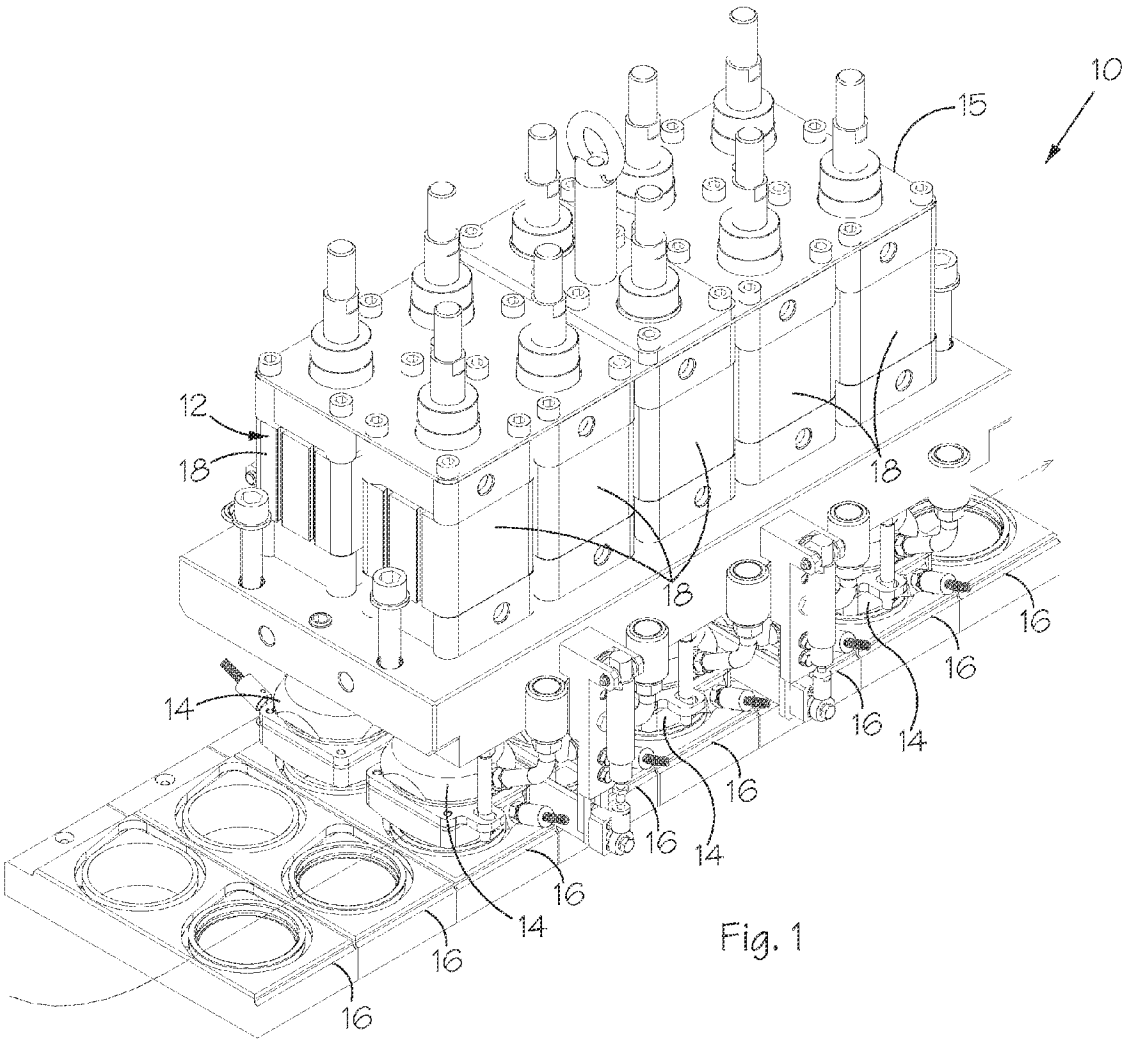
FIG. 1 shows a three-dimensional view of a lidding system in accordance with the invention.
Figure 2:
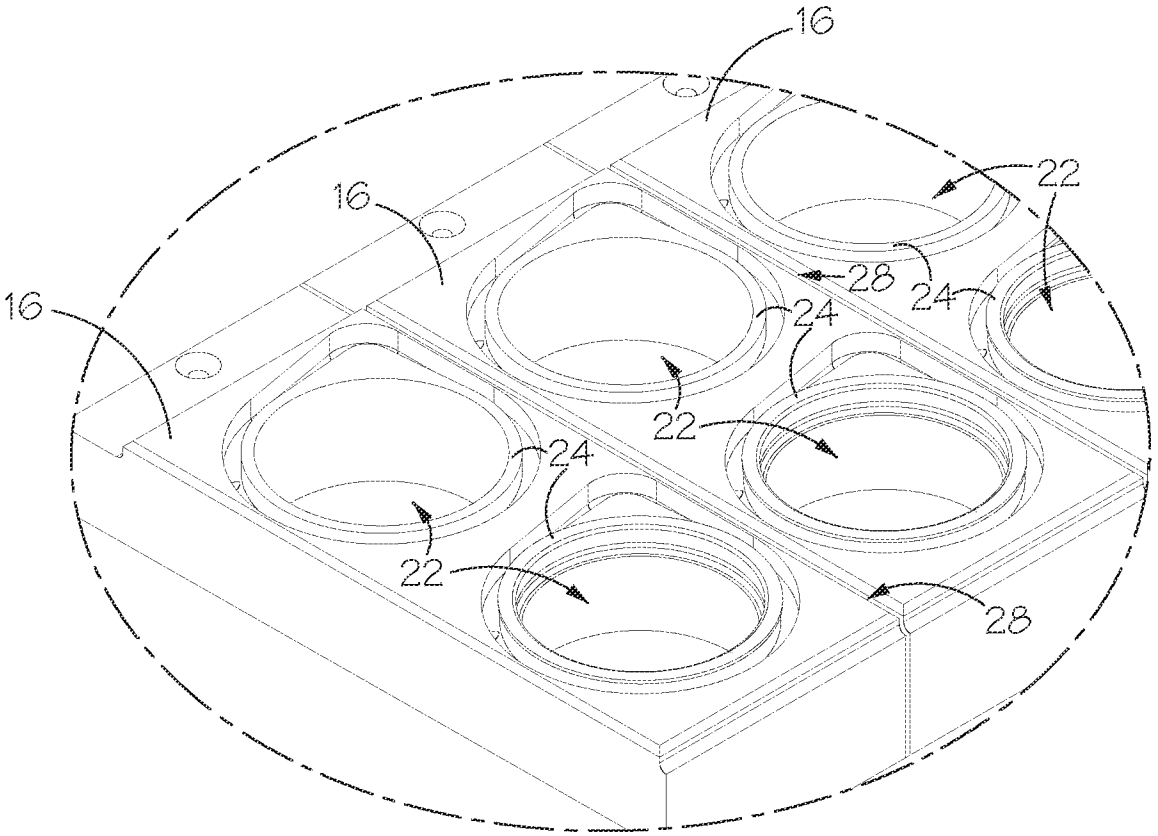
FIG. 2 has an enlarged fragmentary view of the carrier plates of the lidding system of FIG. 1, for supporting a queue of containers to be lidded.
Figure 3:
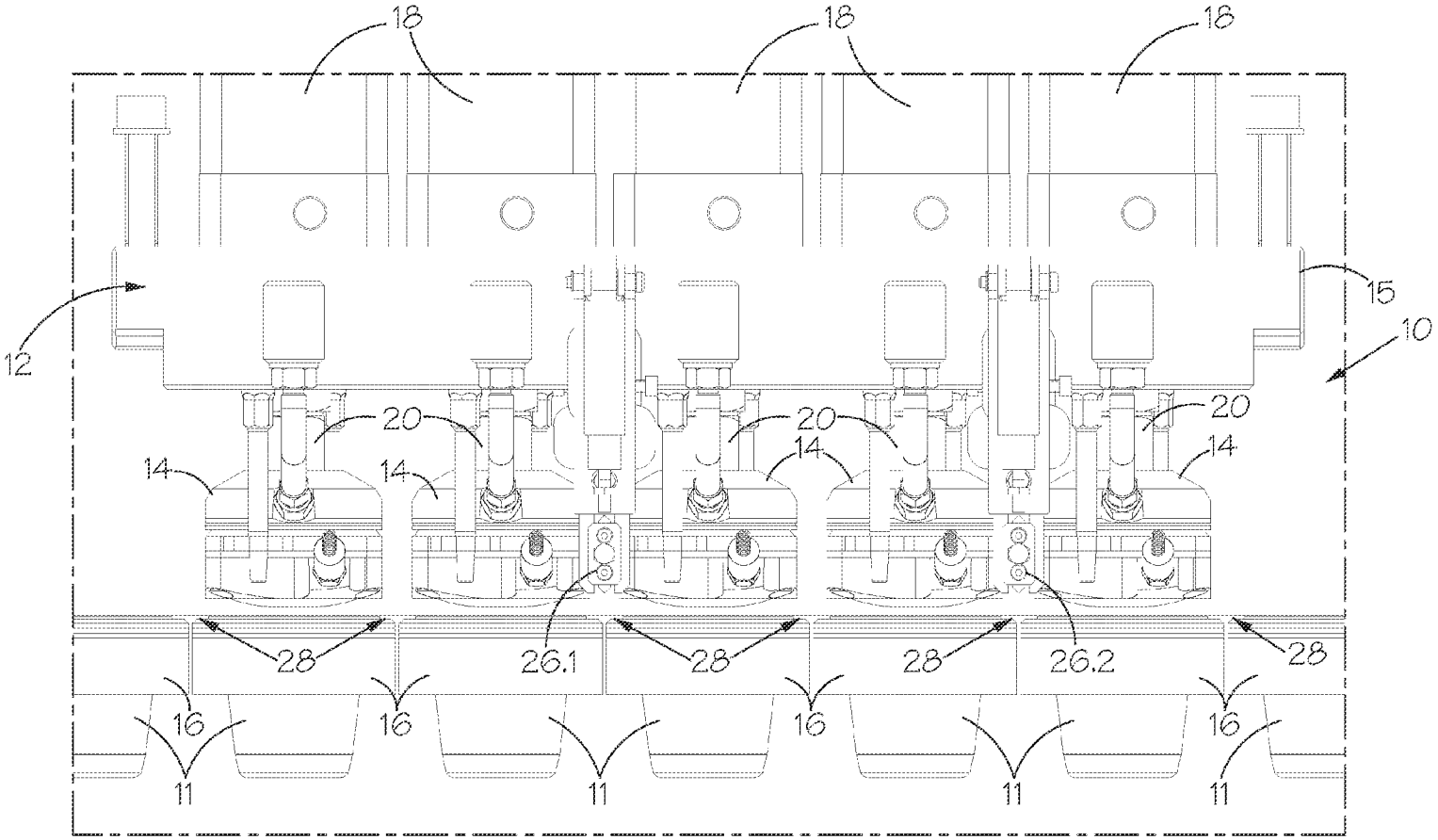
FIG. 3 shows a fragmentary side view of the lidding system of FIG. 1, with both of the web adjustment bars thereof in raised conditions.
Figure 4:
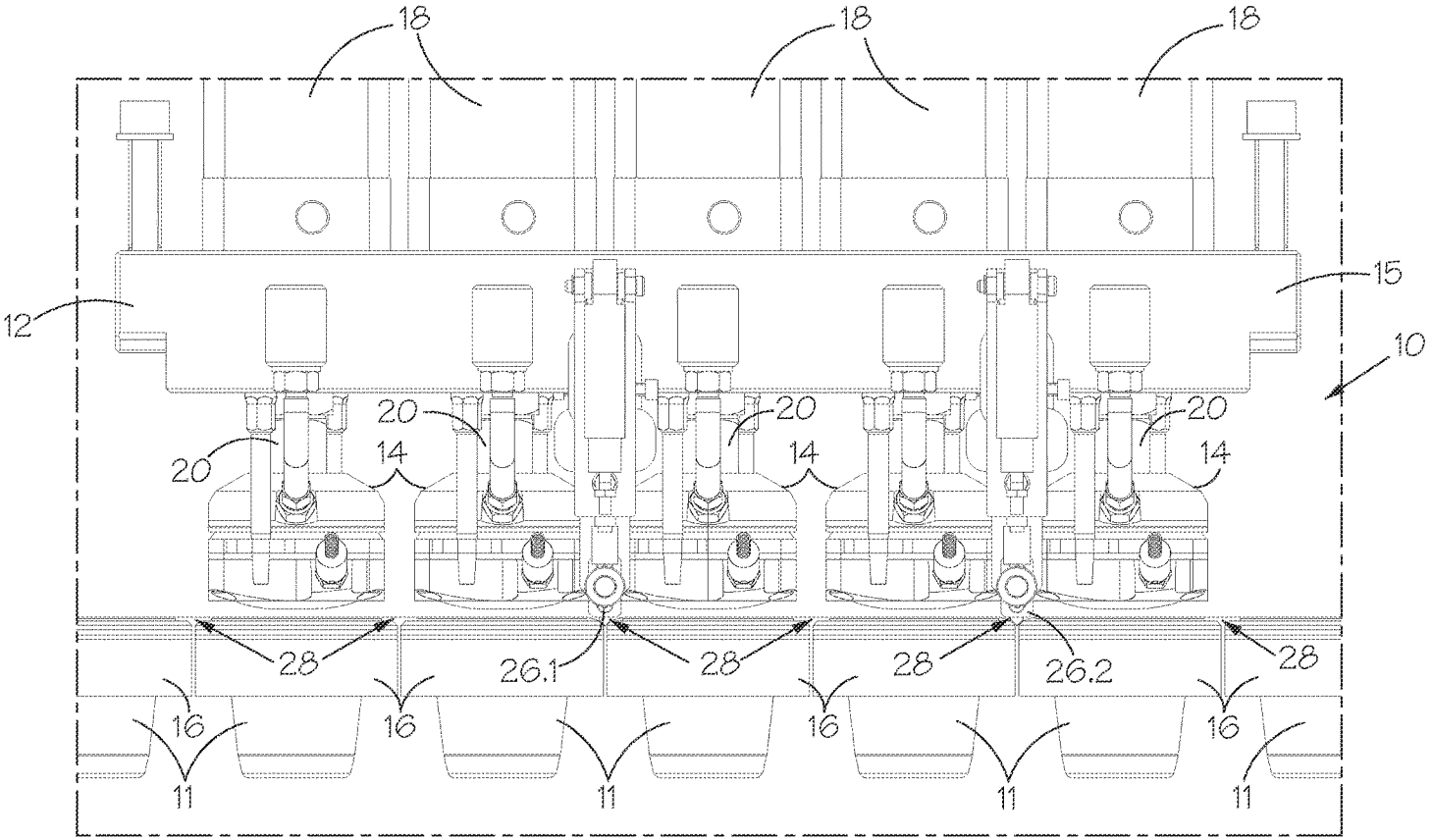
FIG. 4 shows a fragmentary side view of the lidding system of FIG. 1, with both of the web adjustment bars in lowered positions thereof.
Figure 5:
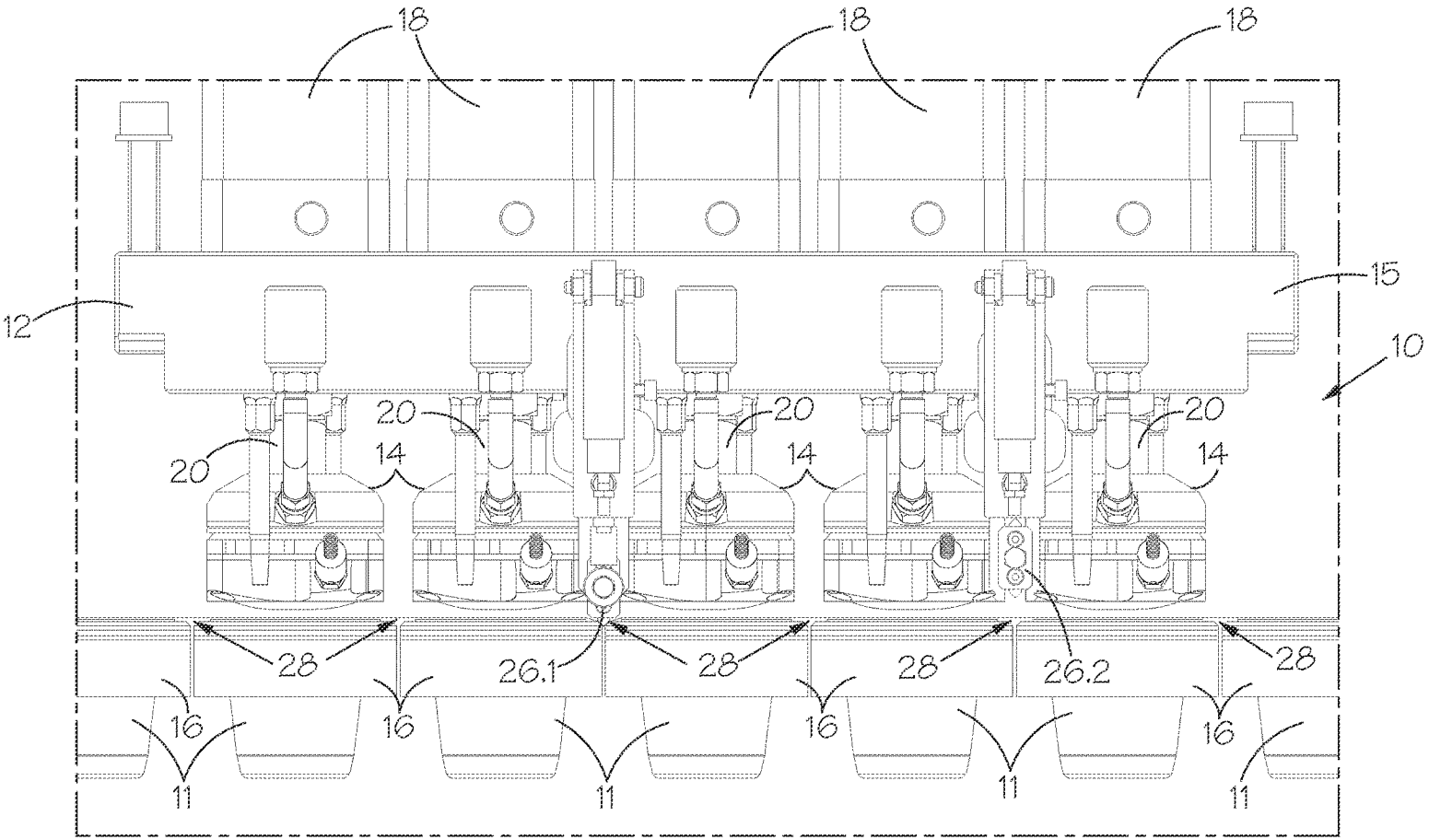
FIG. 5 shows a fragmentary side view of the lidding system of FIG. 1, with one of the web adjustment bars in a raised position and the other web adjustment bar in a lowered position.

With reference to the drawings, a lidding system for sealing thin-walled open-topped containers 11, in accordance with the invention, is designated generally by the reference numeral 10. The lidding system is configured for heat sealing a lidding web onto the containers 11 in a continuous operation. As such, the lidding web and the containers are of compatible heat-sealable plastics material. Each container has a generally cylindrical side wall and a top peripheral flange onto which the lidding web is heat sealed by the sealing head.

The lidding system includes support means in the form of a drum (not shown) for supporting a roll of the lidding web for sealing the containers. The lidding web has a plurality of indicia in the form of discrete labels which have been printed onto the lidding web in a predetermined pattern.

The lidding system further includes a heat sealing head 12 including two rows of five movable heat sealing dies 14 which each have a heat sealing face configured to seal the lidding web onto the flange of a particular one of the containers. The heat sealing head 12 includes a carrier structure 15 on which the dies 14 are supported. A pneumatic cylinder 18 and ram 20 is provided for the operation of each die. The pneumatic cylinder and ram provide for vertical displacement of each heat sealing die between a raised position wherein the heat sealing face of the heat sealing die is spaced above the carrier plates and a lowered position wherein the heat sealing face of the heat sealing die pushes the lidding web downwardly onto the flange of a particular container aligned therewith for heat sealing the lidding web onto the open top of the container. The heat sealing face of each die is heated by means of a thermostatically-controlled heater. In use, the carrier structure 15 oscillates between raised and lowered positions.

The lidding system includes a plurality of carrier plates 16 for supporting a queue of the containers 11. Each carrier plate supports two containers in a side-by-side arrangement such that the containers are supported by the carrier plates in two rows. The carrier plates are displaced horizontally in a linear direction past the sealing head. The lidding material is unrolled from the drum by the linear movement of the carrier plates after the lidding material has been sealed onto leading containers in the carrier plates.

Each carrier plate includes a pair of container support formations for supporting two of the containers in an upright configuration during heat sealing of the lidding web onto the containers by the heat sealing dies. More specifically, each container support formation defines a central aperture 22 within which a side wall of the container is received and an annular support face 24 on which an underside of the flange of the container is supported in a horizontal orientation. The carrier plates 16 are longitudinally-spaced and as such, define transverse slots 28 between them, the purpose of which will be explained hereinbelow.

The lidding system includes indicia sensing means in the form of an optical sensor for sensing the position of the labels on the lidding web.

Figure 7:
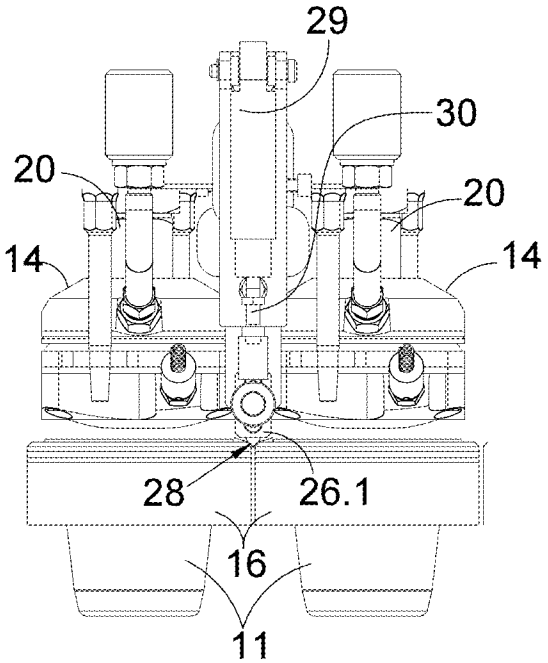
FIG. 7 shows a fragmentary side view lidding system of FIG. 1, illustrating two sealing dies and a web adjustment bar located between the sealing dies, in a lowered position.
Figure 6:
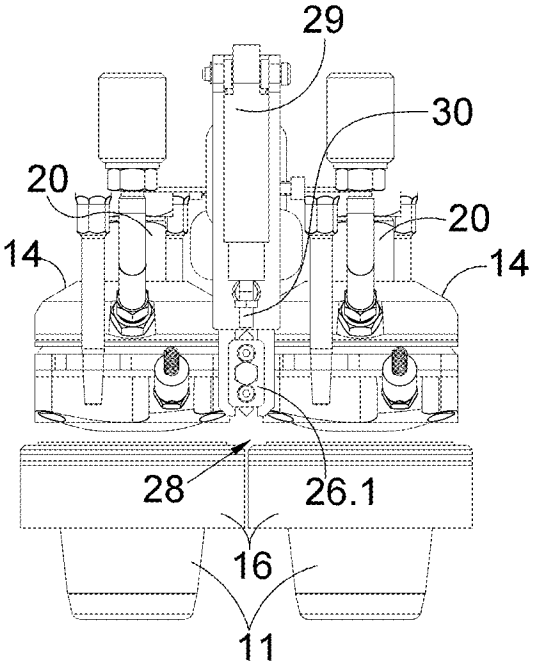
FIG. 6 shows a fragmentary side view of the lidding system of FIG. 1, illustrating two of the sealing dies and a web adjustment bar located between the sealing dies in a raised position.
Figure 8:
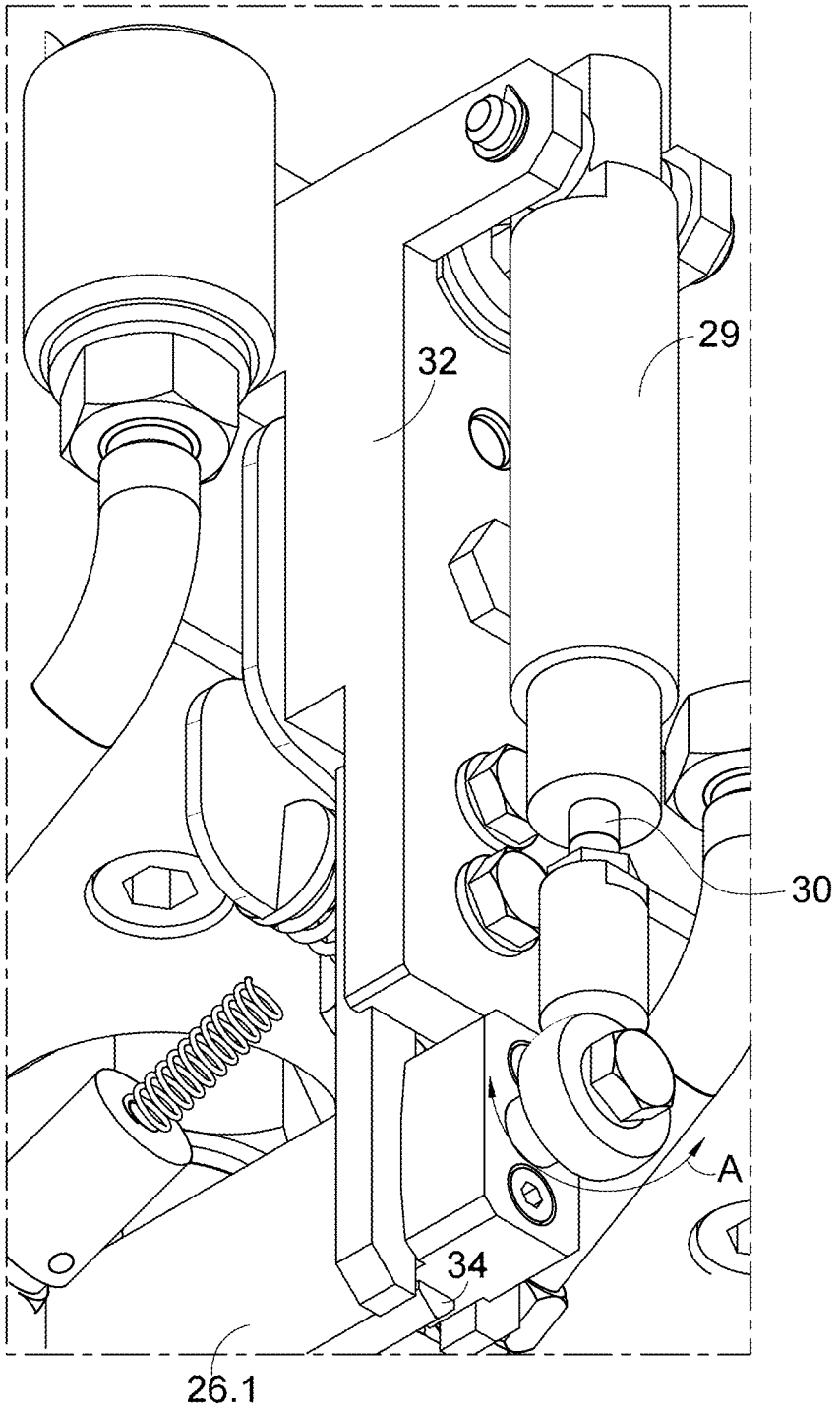
FIG. 8 shows an enlarged fragmentary view of the lidding system of FIG. 1, illustrating further detail of a web adjustment bar of the lidding system.

The lidding system further includes a pair of web adjustment bars in the form of pleating bars 26.1 and 26.2 which extend transversely relative to the linear direction of travel of the carrier plates. The lidding system includes a pneumatic cylinder 29 and ram 30 connected to each end of each pleating bar for displacing the pleating bar between a raised position (as shown in FIG. 6) wherein the pleating bar is spaced above the lidding web and a lowered position (as shown in FIG. 7) wherein the pleating bar depresses the lidding web downwardly into the slot 28 defined between two adjacent carrier plates so as to form a pleat in the lidding web. A lower side of each pleating bar defines a pointed pleating formation 34 which is received in a slot 28 defined between two carrier plates. The pleat so formed serves to adjust the position of the labels marked on the web relative to the containers as will be explained in further detail hereinbelow. The pneumatic cylinder at each end of a particular pleating bar is mounted to a swing arm 32 which is pivotally mounted near an upper end thereof to the carrier structure 15 of the sealing head 12. The pivot arm is urged into a vertical "home" position by a coil spring. The pivot arm is operable to swing slightly thereby adjusting the position of the pleating bar associated therewith with the carrier plates. The swinging action is illustrated by arrow A in FIG. 8. The pivot arm prevents fatigue failure of the pleating bar and ensures a consistent pleating action in circumstances wherein the carrier plates are not perfectly synchronized resulting in the slots 28 being slightly out of alignment with a particular one of the pleating bars when it is displaced into its lowered position.

The lidding system includes a programmable logic controller (PLC) for actuating displacement of the pleating bars into their lowered positions for forming the pleats in the lidding web resulting in an adjustment of the position of the labels marked on the web relative to the containers. The PLC is operable to actuate displacement of one or both pleating bars into their lowered positions, in response to a signal received from the optical sensor indicating a deviation of a predetermined magnitude, of the position of the labels on the lidding web from a predetermined set point value corresponding to a reference position of the labels wherein the labels are in register with the open tops of the containers.

The Applicant envisages that in a typical lidding operation, one pleating bar will be actuated for displacement into its lowered position to form a pleat and thereby correct a deviation in the position of the labels on the lidding web relative to the carrier plates thereby to ensure that the labels remain centralized with respect to the containers. Should the magnitude of a deviation (error) in the position of the labels relative to the position of the carrier plates be detected which is sufficiently large to reach a second set point value, the PLC generates an actuation signal for actuating displacement of both pleating bars simultaneously thereby effecting a relatively larger correction in the position of the labels relative to the containers.

Figure 9:
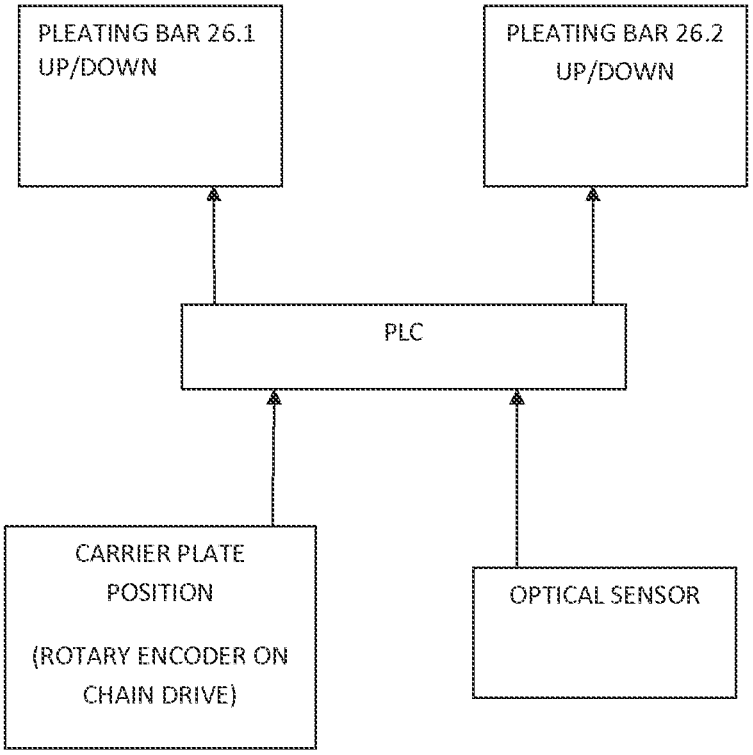
FIG. 9 shows a schematic block diagram illustrating control of the movement of the web adjustment bars during a heat sealing operation using the lidding system of FIG. 1.
Figure 12:
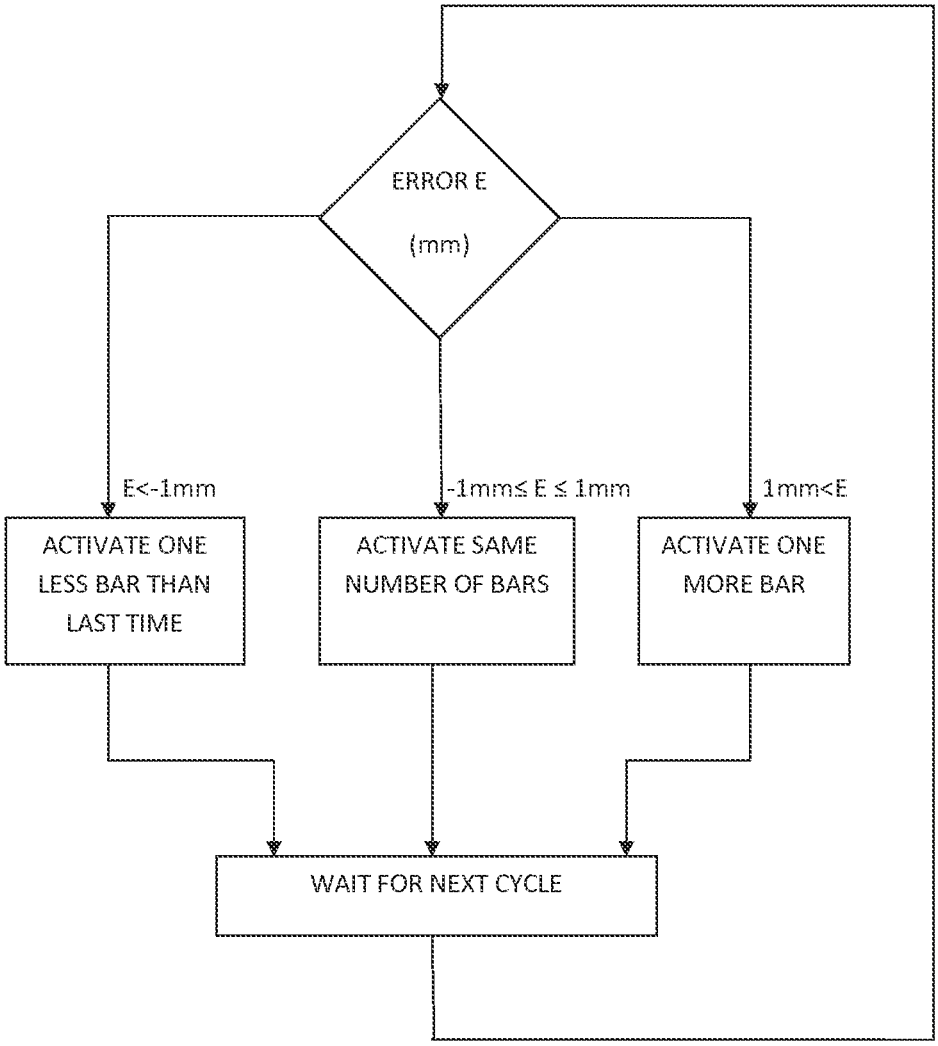
FIG. 12 shows a flowchart illustrating control of the actuation of the web adjustment bars of the lidding system of FIG. 1.

In FIGS. 9 and 12, control of the displacement of the pleating bars 26.1, 26.2 by the PLC is illustrated. A rotary encoder is provided on a chain drive for displacing the carrier plates for determining the position of the carrier plates. The rotary encoder together with the optical sensor provide inputs to the PLC. FIG. 9 shows a schematic block diagram illustrating the operation of the PLC for generating actuating signals for actuating displacement of the web adjustment bars.

Figure 10:
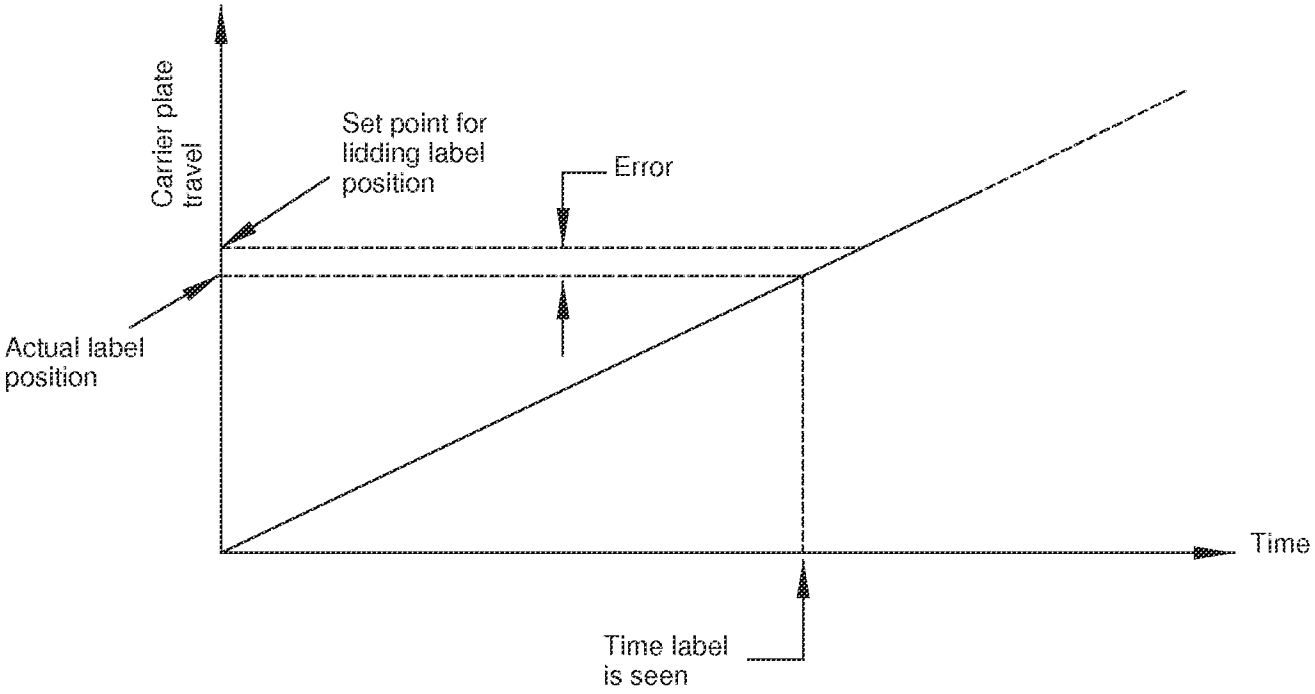
FIG. 10 shows a graph illustrating a control scheme for actuation of the web adjustment bars.

In FIG. 10 a graph is shown illustrating the detection of an error between the actual position of a label and the position of a carrier plate associated therewith.

Figure 11:
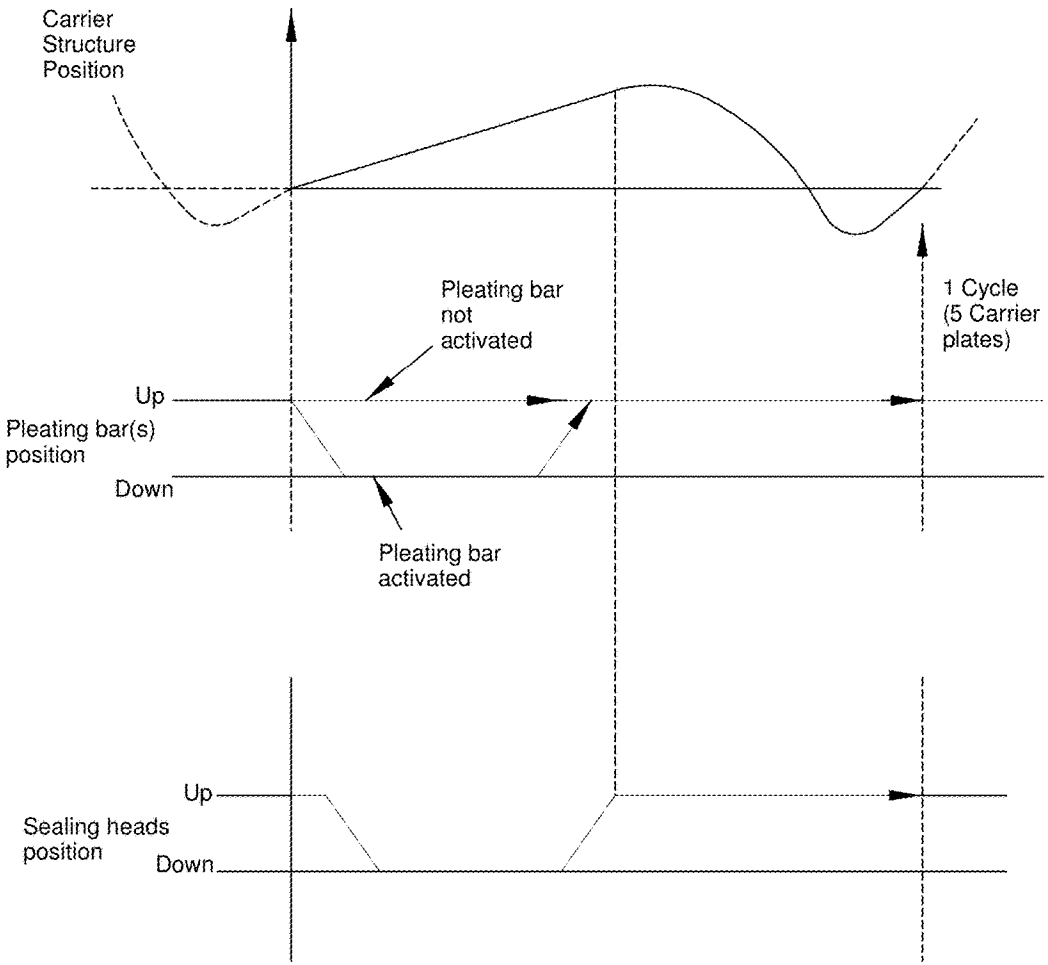
FIG. 11 shows relative displacement of the web adjustment bars and sealing heads, respectively, relative to the position of the carrier plates carrying containers to be lidded.

FIG. 11 shows graphs illustrating relative positions of the carrier structure of the sealing head, the pleating bars and the sealing heads during a single cycle of the lidding system wherein five carrier plates are positioned below corresponding heat sealing dies during heat sealing of lidding web material onto the containers supported by the carrier plates.

FIG. 12 illustrates in more detail, an algorithm executed by the PLC for controlling the actuation of one or both pleating bars depending on the magnitude of deviation detected by the PLC where the error thresholds are −1 mm and 1 mm.

The invention extends to a feed control sub-system of the lidding system, which includes the optical sensor, the pleating bars and the PLC.

The lidding system in accordance with the invention, provides a simple, yet effective system for sealing open-topped containers.

More specifically, the lidding system obviates the need to stretch the lidding web in order to correct misalignment of the position of the labels on the lidding web relative to the containers to be lidded. Stretching is undesirable as it may affect the barrier properties of the lidding material.

Furthermore, the lidding system obviates the need to cut out the lids at the sealing station, which may result in contamination of the sealing dies with the product to be sealed thereby compromising the quality of the seal.

In addition, the lidding system in accordance with the invention, does not require a complicated servo-driven lidding rewind system which is a feature of many known conventional lidding systems.

The invention claimed is:

1. A feed control system for controlling a feed of a lidding web and having a plurality of indicia marked thereon in a predetermined pattern, for sealing open-topped containers having top peripheral flanges, the lidding web being fed relative to a queue of the containers which are carried by longitudinally-spaced carrier plates in a linear direction past a sealing head including a number of sealing dies which are each configured to seal the lidding material onto the flange of one of the containers, the lidding material being dispensed by the movement of the carrier plates after the lidding material has been sealed onto leading containers in the carrier plates, the feed control system comprising:

indicia sensing means for sensing a position of the indicia on the lidding web;

at least one web adjustment bar which extends transversely relative to the linear direction of travel of the carrier plates and which is moveable between a raised position wherein the web adjustment bar is spaced above the web of lidding material and a lowered position wherein the web adjustment bar depresses the lidding web downwardly into a space defined between two longitudinally-adjacent carrier plates so as to form a pleat in the lidding web thereby to adjust the position of the indicia marked on the web, relative to the position of the containers; and control means for actuating said movement of the web adjustment bar into the lowered position thereof for forming the pleat in the lidding web, in response to a signal received from the indicia sensing means indicating a deviation of a predetermined magnitude of said position of the indicia on the lidding web, from a reference position of the indicia wherein the indicia are in register with the containers to be lidded.

2. A lidding system for sealing open-topped containers which each have a top peripheral flange, the lidding system comprising:

support means for supporting a lidding web for sealing the containers, the lidding web having a plurality of indicia marked thereon in a predetermined pattern;

a sealing head including a number of sealing dies which are each configured to seal the lidding web onto the flange of one of the containers;

carrier means for supporting and conveying the containers, including a plurality of longitudinally-spaced carrier plates for supporting a queue of the containers, the carrier means defining transversely-extending recess formations between adjacent carrier plates;

displacement means for displacing the carrier plates in a linear direction past the sealing head; and a feed control system comprising:

a) indicia sensing means for sensing a position of the indicia on the lidding web;

b) at least one web adjustment bar which extends transversely relative to the linear direction of travel of the carrier plates and which is moveable between a raised position wherein the web adjustment bar is spaced above the web of lidding material and a lowered position wherein the web adjustment bar depresses the lidding web downwardly into a particular one of the recess formations defined between two adjacent carrier plates so as to form a pleat in the lidding web thereby to adjust the position of the indicia marked on the web, relative to the position of the containers; and c) control means for actuating said movement of the web adjustment bar into the lowered position thereof for forming the pleat in the lidding web, in response to a signal received from the indicia sensing means indicating a deviation of a predetermined magnitude of said position of the indicia on the lidding web, from a reference position of the indicia wherein the indicia are in register with the containers to be lidded.

3. The lidding system as claimed in claim 2, wherein the lidding system is operable to heat seal the lidding web onto the containers.

4. The lidding system as claimed in claim 3, wherein the lidding web and the containers are of compatible heat-sealable material, with the sealing dies of the sealing head being in the form of heat sealing dies.

5. The lidding system as claimed in claim 2, wherein the lidding web is provided in a roll, with the support means being configured to support a roll of the lidding web.

6. The lidding system as claimed in claim 2, wherein the sealing head is moveable relative to the carrier means so as to provide for sealing of the lidding web onto the flanges of predetermined containers supported by the carrier means.

* * * * *